US008106825B1

(12) United States Patent
Wangsness

(10) Patent No.: US 8,106,825 B1
(45) Date of Patent: Jan. 31, 2012

(54) DISTRIBUTED RECEIVER

(75) Inventor: Todd Wangsness, Murrieta, CA (US)

(73) Assignee: OmniPhase Research Laboratories, Inc., Newport Beach, CA (US)

( * ) Notice: Subject to any disclaimer, the term of this patent is extended or adjusted under 35 U.S.C. 154(b) by 329 days.

(21) Appl. No.: 12/016,187

(22) Filed: Jan. 17, 2008

Related U.S. Application Data

(60) Provisional application No. 60/885,217, filed on Jan. 17, 2007.

(51) Int. Cl.
*H01Q 3/00* (2006.01)

(52) U.S. Cl. ..... 342/368

(58) Field of Classification Search ..... 342/367–368
See application file for complete search history.

(56) References Cited

U.S. PATENT DOCUMENTS

| | | | | |
|---|---|---|---|---|
| 5,940,032 | A * | 8/1999 | Passmann et al. | 342/372 |
| 2004/0090365 | A1 * | 5/2004 | Newberg et al. | 342/368 |
| 2006/0193410 | A1 * | 8/2006 | Moorti et al. | 375/347 |

* cited by examiner

*Primary Examiner* — Thomas Tarcza
*Assistant Examiner* — Nga X Nguyen
(74) *Attorney, Agent, or Firm* — The Eclipse Group LLP

(57) ABSTRACT

A distributed receiver in signal communication with an active antenna array is described. The distributed receiver may include an exciter, a plurality of transmit/receive ("T/R") modules, and a frequency source operable to provide a frequency reference signal to the T/R modules.

3 Claims, 7 Drawing Sheets

DISTRIBUTED RECEIVER

CROSS-REFERENCE TO RELATED APPLICATIONS

This application claims priority to U.S. Provisional patent application No. 60/885,217, titled "Distributed Receiver," filed on Jan. 17, 2007, which is herein incorporated by reference in its entirety.

BACKGROUND OF THE INVENTION

1. Field of Invention

This invention relates in general to antenna beam-forming, and more particularly, to a transmit/receive module architecture for a beam-forming antenna array.

2. Related Art

Active phased array antenna systems and/or active aperture array antenna systems (generally known as "active antenna arrays") have become more common place with the advent of individual solid-state transmit/receive (T/R) microwave module element (known as "T/R modules"), thus avoiding the distribution and phase shifter losses generally encountered in the passive array antennas. As such, the performance of modern radar systems with active antenna arrays is mainly driven by the performance of these T/R modules. In general, for the same radiated power, active antenna arrays have been found to be more efficient, smaller and lighter than conventional passive array antenna systems. Due to the close connection of the T/R modules to the radiating elements, the losses in both cases (i.e., transmit and receive losses) are low, compared to the passive array systems. This generally leads to a low received noise-figure and high transmit efficiency. Furthermore, active antenna array techniques may help satisfy the need to generate large amounts of power for long-range surveillance and tracking radar systems. Moreover, active antenna arrays allow for low sidelobe level control on the radar receive mode, adaptive null placement to minimize jamming, and beam forming and steering applications. In summary, the functions of a T/R module include generation of transmit power, low noise amplification of received signals coupled to and received from the respective radiating element, phase shift in transmit and receive modes for beam forming and/or steering, and variable gain setting for aperture weighing during reception. It is appreciated by those skilled in the art that depending upon the design requirements, a typical beam-forming antenna array may include thousands of T/R modules.

Unfortunately, cost is always an issue for a resulting complex of a large number of T/R modules. In addition, microwave plumbing is required both to supply the microwave radio frequency ("RF") signal to be transmitted to each T/R module and to receive microwave RF signals from the T/R modules once an incoming signal has been received. In the receiving case, the received signal from the various T/R modules is typically combined in a microwave transmission network and presented as composite signal to a baseband or intermediate frequency ("IF") processing stage. For example, consider a radar phased array antenna 100 shown in FIG. 1. As is known in the art, this radar phased array antenna 100 may be utilized to track N multiple targets such as, for example, targets 102, 104, 106, and 108 (it is appreciated that only four targets are shown for simplicity) with N individual antenna beams such as beams 110, 112, 114, and 116, respectively. Each target produces a particular spectral return depending upon its Doppler and range properties relative to the radar phased array antenna 100. As an example in FIG. 2, the first target 102 may produce a first target spectrum 200 versus offset frequency, the second target 104 may produce a second target spectrum 202 versus offset frequency, the third target 102 may produce a third target spectrum 204 versus offset frequency, the fourth target 104 may produce a second target spectrum 206 versus offset frequency. The resulting combined spectrum signal 208 will contain these various spectral returns.

Unfortunately, although T/R modules have improved the efficiency and cost of active antenna arrays, there are several still significant drawbacks involved in processing the combined spectrum signal 208 shown in FIG. 2 resulting from an active antenna array. For example, one drawback is that there is insertion loss from each T/R module to a received signal network (not shown) that may include a plurality of associated RF combiners and couplers. In addition, it is difficult to precisely match the phase of the received signals and/or their amplitudes between individual T/R modules. Moreover, impedance matching of the T/R modules to the microwave transmission and/or reception network is typically a formidable task. Moreover, the receiver noise-floor tends to degrade as the various received RF signals from the T/R modules are combined in the microwave transmission network. In addition, the combination of the various received RF signals generally tends to degrade the desirable ability to sector an active antenna array so as to track multiple targets.

Therefore there is a need for an improved active antenna array using a T/R architecture that is capable of overcoming the problems discussed above.

SUMMARY

A distributed receiver in signal communication with an active antenna array is described. The distributed receiver may include an exciter, a plurality of transmit/receive ("T/R") modules, and a frequency source. The exciter operable to provide an RF signal. The plurality of T/R modules are configured to receive the RF signal from the exciter through a first transmission network, where each T/R module is configured to phase-shift the RF signal responsive to a control signal and transmit a resulting phase-shifted RF signal through a corresponding antenna. The T/R module is also configured to phase-shift a received RF signal from the corresponding antenna to provide a phase-shifted received RF signal. The frequency source is operable to provide a frequency reference signal to the T/R modules through a second transmission network, wherein each T/R module is configured to direct down-convert its phase-shifted received RF signal responsive to the frequency reference signal to provide a down-converted signal.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of this invention.

A distributed receiver is disclosed that includes a transmit/receive ("T/R") module architecture that interfaces with an active antenna array. The distributed receiver may include an exciter, a plurality of T/R modules, and frequency source. The exciter is capable of providing an radio frequency ("RF") signal to the plurality of T/R modules and each T/R module is capable of phase-shifting the received RF signal responsive to a control signal from a controller and then transmitting the phase-shifted signal through the a part of the active antenna array. Each T/R module is also capable of receiving a received RF signal from a part of the active antenna array and, in response, phase-shift the received RF signal to produce a phase-shifted received RF signal. The frequency source is a device capable of producing a stable frequency reference signal (such as, for example, a local oscillator ("LO") signal) that may be passed to the individual T/R modules. The T/R modules are configured to direct down-convert the phase-shifted received RF signal in response to receiving the stable frequency reference signal. As an example, the frequency source may be a LO.

Figure 1:
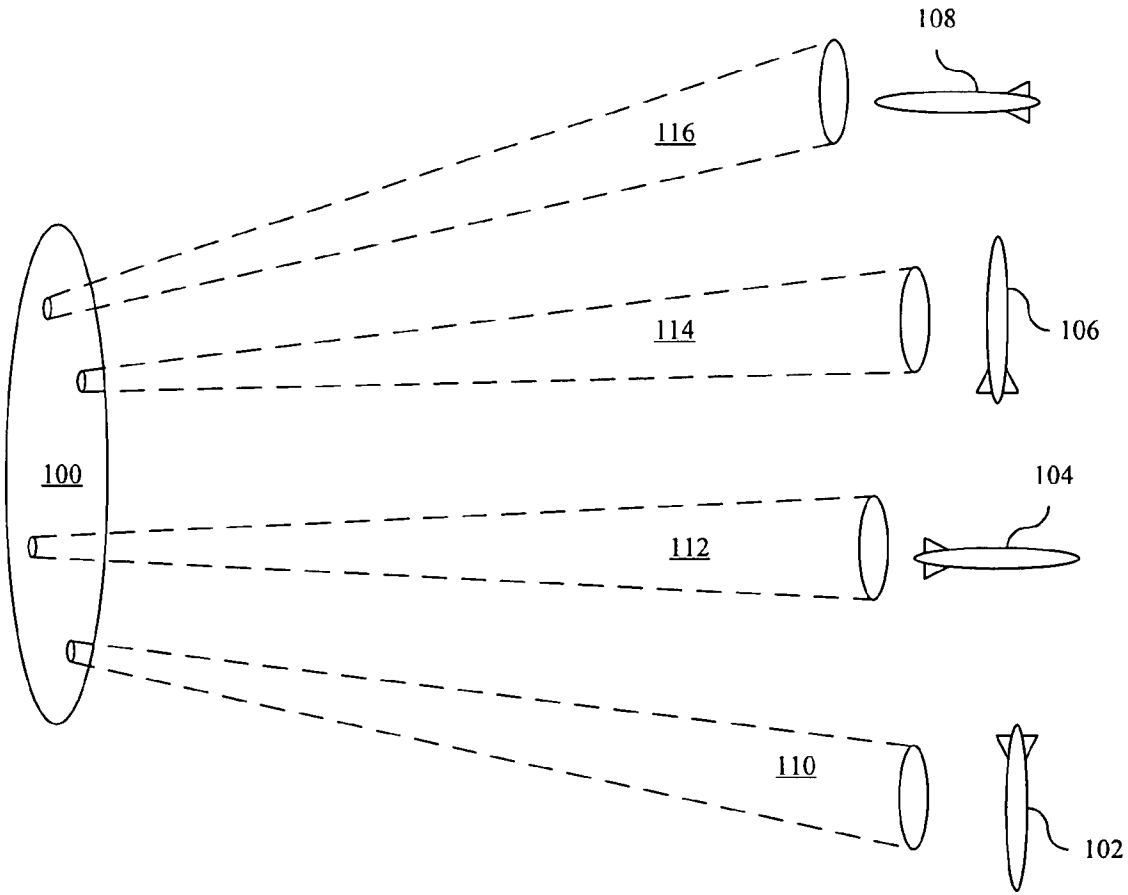
FIG. 1 (Prior Art)
FIG. 1 shows an active antenna array tracking a plurality of targets.
Figure 2:
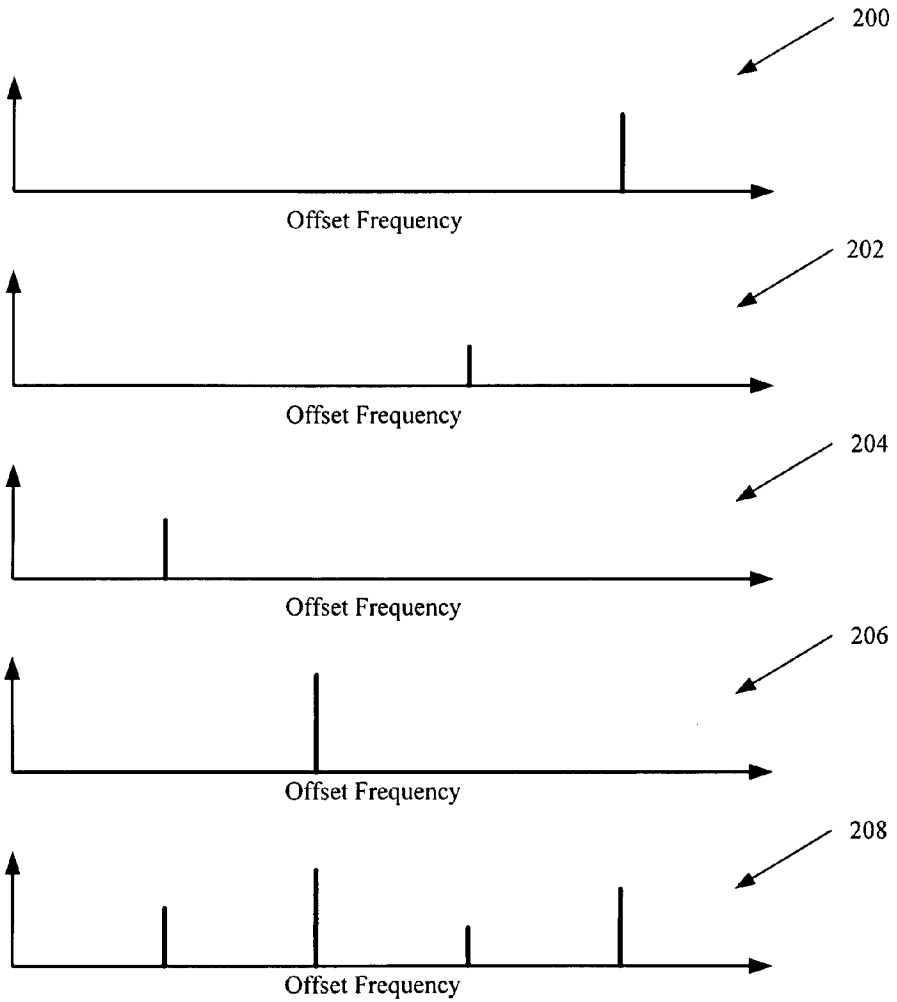
FIG. 2 (Prior Art)
FIG. 2 shows a plurality of plots of target spectrums versus offset frequency and a plot of the resulting combined spectrum signal.

As an example of operation in a reception mode, a combined received RF signal (or individual RF signals) is received at the active antenna array and passed to the plurality of T/R modules. Each T/R module receives a portion of the received RF signal and down-converts the portion of the received RF signal to either a baseband or an intermediate frequency ("IF") signal that is capable of being digitized. As a result, the assorted problems of integrating a microwave transmission network so as to provide a single combined RF signal from the plurality of T/R modules is avoided. As compared to the combined target spectrum 208 shown in FIG. 2, the distributed receiver instead may provide a plurality of digital signals that represent the plurality of down-converted signals. For example, a subset of T/R modules may electronically steer their beam so as to track the first target 102, another subset of T/R modules may electronically steer their beam so as to track the second target 104, and so on. The resulting digital down-converted signals from each subset of T/R modules is then digitally combined. This combination is very flexible and fluid because the distributed receiver need merely identify the digital signals assigned to each sub-array of T/R modules.

The digital signals from the T/R modules may be organized in parallel utilizing, for example, conventional digital bus protocols. As an example, suppose there are thousands of T/R modules. Each T/R module may be assigned a unique address that corresponds to the digitized RF signal it produces. In one implementation, the T/R modules may be sequentially numbered to provide their unique address. For example, a set of T/R modules (designated as 1 through 100) may be tracking the first target 102, while another set (designated as 201 through 300) may be tracking the second target 104, and so on. To form the appropriate digital combined RF signal for the various sub-arrays of T/R modules, the distributed receiver may then combine the digitized signals accordingly. As an example, the distributed receiver may combine the digital signals corresponding to T/R modules 1 through 100 to form first target spectrum 200, while the digital signals corresponding to T/R modules 201 through 300 may be utilized to form the second target spectrum 202, and so on.

Utilizing this approach, the noise-floor and other spectral degradations that are introduced by combining the RF signals from the various T/R modules as practiced in conventional phased arrays is avoided. Moreover, the complex and difficult impedance matching of the T/R modules to a combining RF transmission network is also avoided as are the insertion losses encountered in conventional phased array architectures.

As discussed above, the received RF signal from each T/R module may be down-converted either to baseband or to IF. A direct down-conversion to baseband eliminates the IF processing stages and their associated losses and spectral degradations. However, conventional direct down-conversion techniques are typically plagued by a DC offset problem arising from LO self mixing, LO coupling back to a low noise amplifier ("LNA"), mixer second-order distortion, and envelope detection of interfering amplitude modulation ("AM") signals. Additionally, there are significant issues arising from the contribution of LO ½ noise, reciprocal mixing, and LO spurious signals. A direct down-conversion architecture is disclosed in U.S. Pat. No. 6,745,020, (filed on Aug. 29, 2002, the contents of which are herein incorporated by reference in its entirety) that avoids the DC offset problem.

Figure 3:
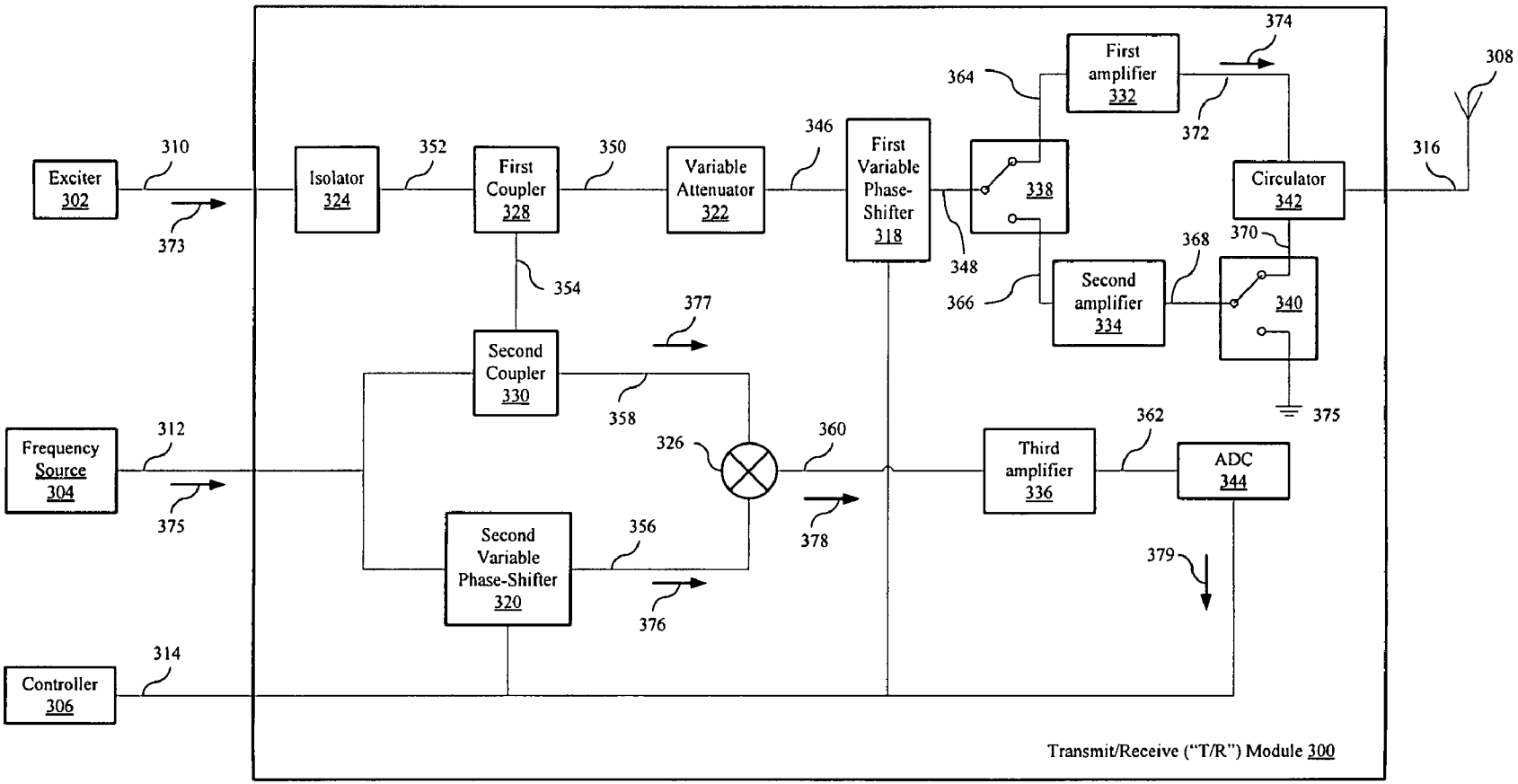
FIG. 3 shows an example of an implementation of a T/R module in accordance with the invention.

Turning to FIG. 3, an example of an implementation of a T/R module 300 in accordance with the invention is shown. The T/R module 300 incorporates the direct down-conversion architecture of U.S. Pat. No. 6,745,020. The T/R module 300 may be in signal communication with an exciter 302, frequency source 304, controller 306, and antenna 308 via signal paths 310, 312, 314, and 316, respectively. The T/R module 300 may include a first variable phase-shifter 318, a second variable phase-shifter 320, variable attenuator 322, isolator 324, mixer 326, first coupler 328, second coupler 330, first amplifier 332, second amplifier 334, third amplifier 336, first transmit/receive switch 338, second transmit/receive switch 340, circulator 342, and analog-to-digital converter ("ADC") 344. The first amplifier 332 may be a pre-amplifier, power amplifier, or low-noise amplifier ("LNA"). The second amplifier 334 may be an LNA. The third amplifier 336 may be a video amplifier. The first variable phase-shifter 318 may be in signal communication with the controller 306, variable attenuator 322, and first transmit/receive switch 338, via signal paths 314, 346, and 348, respectively. The first coupler 328 may be in signal communication with the variable attenuator 322, isolator 324, and second coupler 330 via signal path 350, 352, and 354, respectively. The isolator 324 may be in signal communication with the exciter 302 via signal path 310 and the mixer 326 may be in signal communication with the second variable phase-shifter 320, second coupler 330, and third amplifier 336 via signal path 356, 358, and 360, respectively. The frequency source 304 may be in signal communication with both the second variable phase-shifter 320 and second coupler 330 via signal path 312 and the controller 306 may be in signal communication with the first variable phase-shifter 318, second variable phase-shifter 320, and ADC 344 via signal path 314. The third amplifier 336 may be in signal communication with the ADC 344 via signal path 362. The first transmit/receive switch 338 may be in signal communication with the first amplifier 332 and second amplifier 334 via signal paths 364 and 366, respectively; and the second transmit/receive switch 340 may be in signal communication with the second amplifier 334 and circulator 342 via signal paths 368 and 370, respectively. The circulator 342 may be in signal communication with the first amplifier 332 and antenna 308 via signal paths 372 and 316, respectively.

It is appreciated by those skilled in the art that the term "in signal communication" means any communication and/or electromagnetic, acoustic, digital, or information-carrying connection and/or coupling along any signal path between two devices that allows signals (including both non-information and information-carrying signals) and/or information to pass from one device to another and includes wireless, wired, analog, and/or digital signal paths. The "signal paths" may be physical such as, for example, conductive wires, electromagnetic transmission lines and/or waveguides, attached and/or electromagnetic or mechanically coupled terminals, semiconductive or dielectric materials or devices, or other similar physical connections or couplings. Additionally, the signal paths may be non-physical such as free-space (in the case of electromagnetic propagation) or information-carrying paths through digital components where communication information is passed from one device to another in varying digital formats without necessarily passing through a direct electromagnetic connection.

As an example of operation, in the T/R module 300, the first variable phase-shifter 305 and a variable attenuator 322 are shared in both the transmit and receive channels. To enable this sharing, the first variable phase-shifter 318 is in signal communication with the first transmit/receive switch 338. In a transmit configuration, the exciter 302 provides an RF signal 373 to be transmitted through the isolator 324, variable attenuator 322, and first variable phase-shifter 318. The first transmit/receive switch 338 then places in signal communication the output from the first variable phase-shifter 318 to the input of the first amplifier 332. A resulting amplified and phase-shifted signal 374 from the first amplifier 332 is then coupled through the circulator 342 to the antenna (or antennas) 308.

In a receive configuration, a received signal from antenna 308 couples through circulator 342 and through the second transmit/receive switch 340 to the second amplifier 334. From the second amplifier 334, the received signal couples through first transmit/receive switch 338 to first variable phase-shifter 318 and variable attenuator 332. Referring back to the second transmit/receive switch 340, it may be seen that the second transmit/receive switch 340 couples to ground 375 in a transmit configuration to prevent any unwanted reflections of transmitted RF back into the T/R module 300.

The direct down-conversion occurs as follows. A received RF signal from first variable phase-shifter 318 and variable attenuator 322 couples through the first coupler 328 to the second coupler 330 in which the received RF signal is combined with a frequency reference signal 375 (such as, for example, a local LO signal) from the frequency reference 304.

The frequency reference signal 375 is split to feed both second coupler 330 and the second variable phase-shifter 320. The second variable phase-shifter 320 is controlled so as to be in quadrature with the frequency reference signal 375. The mixer 326 (which may be, for example, a double sideband or a single sideband mixer) mixes a quadrature frequency reference signal 376, produced by second variable phase-shifter 320, with the combined frequency reference/received RF signal 377 from the second coupler 330. In this example, the frequency reference signal 375 and the quadrature frequency reference signal 376 do not produce a DC offset component in the baseband signal output 378 from mixer 326 as discussed in U.S. Pat. No. 6,745,020. The baseband signal output 378 may then amplified in the third amplifier 336 and digitized in the ADC 344. The controller 306 receives the resulting digitized signal 379 from ADC 344 and controls second variable phase-shifter 320 to maintain a quadrature relationship between the quadrature frequency reference signal 376 and combined frequency reference/received RF signal 377. In this example, the controller 306 may be a controller device, microcontroller, processor, microprocessor, application specific integrated circuit ("ASIC"), digital signal processor ("DSP"), or other similar device. The controller 306 may also control the first variable phase-shifter 318 and variable attenuator 322 to effect the desired beamforming.

Figure 4:
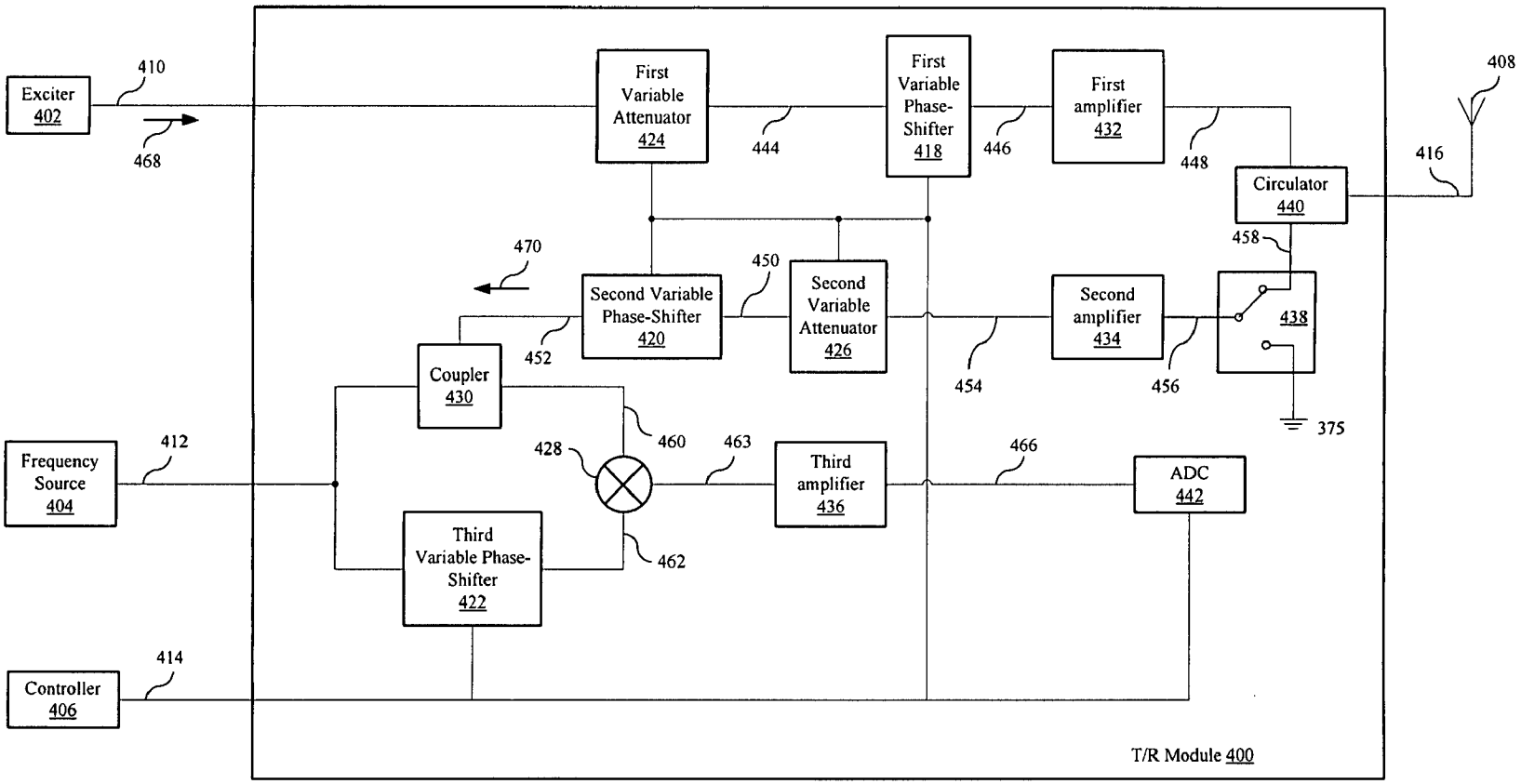
FIG. 4 shows an example of another implementation of a T/R module in accordance with the invention.

In FIG. 4, an example of another implementation of a T/R module 400 is shown in which separate phase-shifters and/or attenuators are provided for the receive and transmit paths. The T/R module 400 may be in signal communication an exciter 402, frequency source 404, controller 406, and antenna 408 via signal paths 410, 412, 414, and 416, respectively. The T/R module 400 may include a first variable phase-shifter 418, second variable phase-shifter 420, third variable phase-shifter 422, first variable attenuator 424, second variable attenuator 426, mixer 428, coupler 430, first amplifier 432, second amplifier 434, third amplifier 436, transmit/receive switch 438, circulator 440, and ADC 442. The first amplifier 432 may be a pre-amplifier, power amplifier, or LNA. The second amplifier 434 may be a LNA. The third amplifier 436 may be a video amplifier. The first variable phase-shifter 418 may be in signal communication with the controller 406, first variable attenuator 424, and first amplifier 432, via signal paths 414, 444, and 446, respectively. The first amplifier 432 may be in signal communication with the circulator 440 via signal path 448. The second variable phase-shifter 420 may be in signal communication with the controller 406, second variable attenuator 426, and coupler 430 via signal paths 414, 450, and 452, respectively. The second variable attenuator 426 may be in signal communication with controller 406 and the second amplifier 434 via signal paths 414 and 454, respectively. The transmit/receive switch 438 may be in signal communication with the second amplifier 434 and circulator 440 via signal paths 456 and 458, respectively. The coupler 430 may be in signal communication with the frequency source 404 and mixer 428 via signal paths 412 and 460, respectively. The third variable phase-shifter 422 may be in signal communication with the frequency source 404 and mixer 428 via signal paths 412 and 462, respectively. The third amplifier 436 may be in signal communication with the mixer 428 and ADC 442 via signal paths 463 and 466, respectively.

In an example of operation in the transmit path, the exciter 402 feeds the first variable attenuator 424 with a RF signal 468, which is passed through the first variable attenuator 424 and first variable phase-shifter 418 and then drives the first amplifier 432 as discussed previously in FIG. 3. In the receive path, the second amplifier 434 feeds the second variable attenuator 426 that couples to the second variable phase-shifter 420. The output signal 470 of the second variable phase-shifter 420 is passed through coupler 430, which is then direct down-converted as discussed with regard to FIG. 3.

Figure 5:
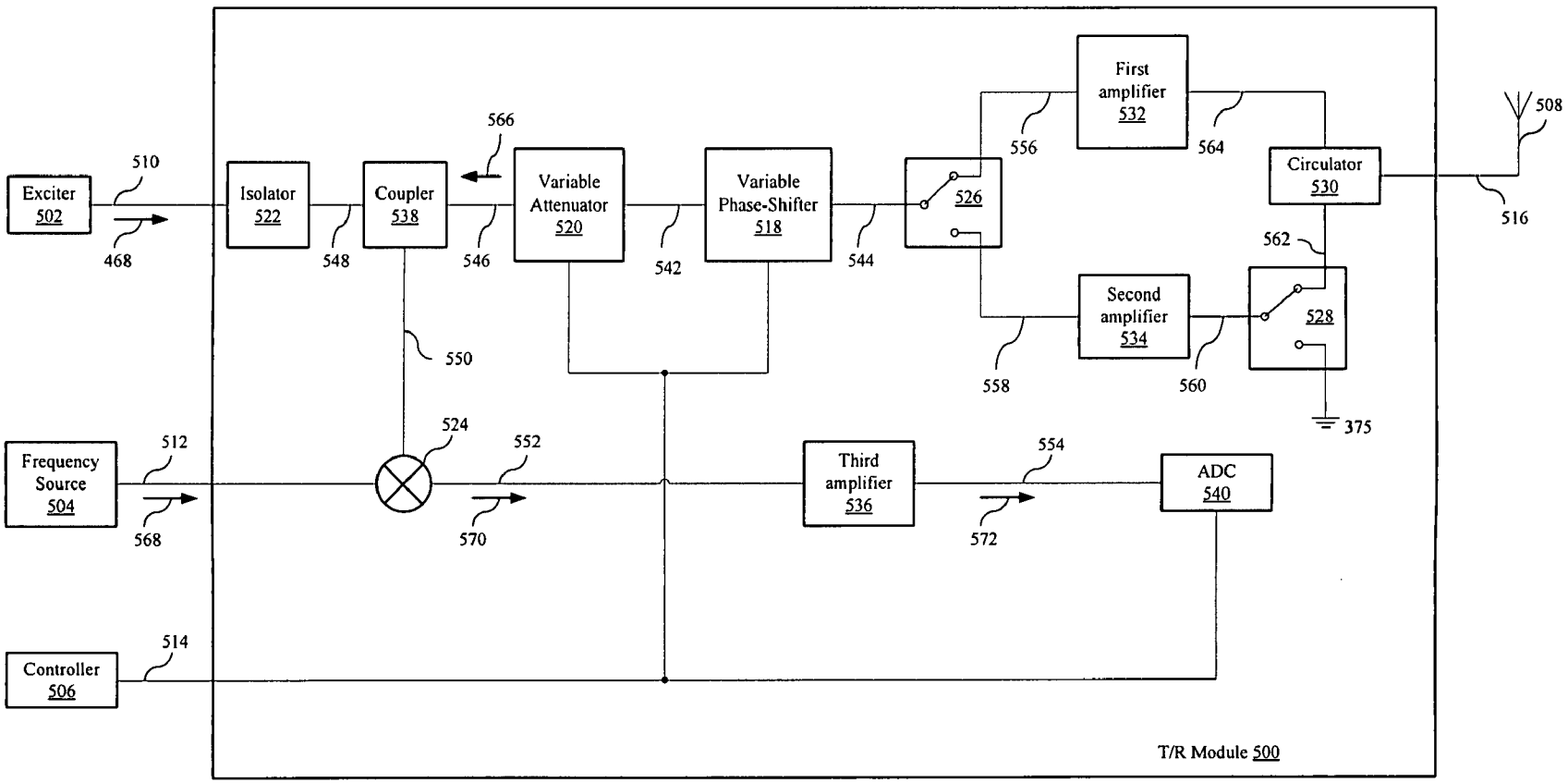
FIG. 5 shows an example of another implementation of a T/R module in accordance with the invention.

In FIG. 5, an example of another implementation of a T/R module 500 in accordance with the invention is shown. Again, the T/R module 500 may be in signal communication an exciter 502, frequency source 504, controller 506, and antenna 508 via signal paths 510, 512, 514, and 516, respectively. The T/R module 500 may include a variable phase-shifter 518, variable attenuator 520, isolator 522, mixer 524, first transmit/receive switch 526, second transmit/receive switch 528, circulator 530, first amplifier 532, second amplifier 534, third amplifier 536, coupler 538, and ADC 540. The first amplifier 532 may be pre-amplifier, power amplifier, or LNA. The second amplifier 534 may be a LNA. The third amplifier 536 may be a video amplifier. The variable phase-shifter 518 may be in signal communication with the controller 506, variable attenuator 520 and first transmit/receive switch 526 via signal paths 514, 542, and 544, respectively. The variable attenuator 520 may be in signal communication with the controller 506 and coupler 538 via signal paths 514 and 546, respectively. The isolator 522 may be in signal communication with the exciter 502 and coupler 538 via signal paths 510 and 548, respectively. The mixer 524 may be in signal communication with the frequency source 504, coupler 538, and third amplifier 536 via signal paths 512, 550, and 552, respectively. The ADC 540 may be in signal path with the controller 506 and third amplifier 536 via signal paths 514 and 554, respectively. The first transmit/receive switch 526 may be in signal communication with the first amplifier 532 and second amplifier 534 via signal paths 556 and 558, respectively. The second transmit/receive switch 528 may be in signal communication with the second amplifier 534 and circulator 530 via signal paths 560 and 562, respectively. The circulator 530 may be in signal communication with the first amplifier 532 and antenna 508 via signal paths 564 and 516, respectively.

Figure 6:
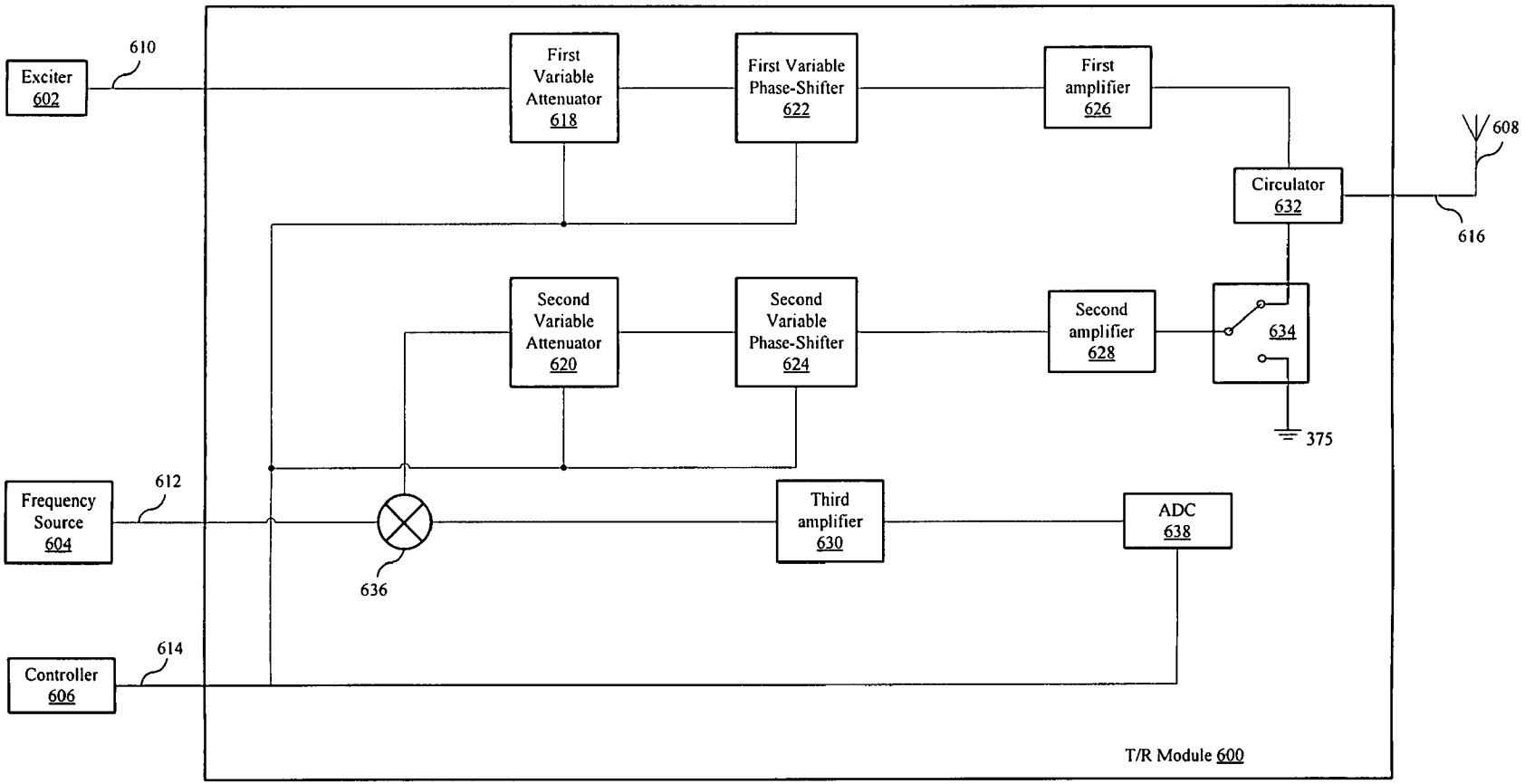
FIG. 6 shows an example of another implementation of a T/R module in accordance with the invention.

FIG. 6 shows an example of another T/R module 600 in accordance with the invention. In this example, the T/R module 600 is a heterodyne T/R module in which separate phase-shifters and/or attenuators are provided for the receive and transmit paths similar to that described with regard to FIG. 4. The T/R module 600 may be in signal communication with an exciter 602, frequency source 604, controller 606, and antenna 608 via signal paths 610, 612, 614, and 616, respectively. The T/R module 600 may include a first variable attenuator 618, second variable attenuator 620, first variable phase-shifter 622, second variable phase-shifter 624, first LNA 626, second LNA 628, third. I-NA 630, circulator 632, transmit/receive switch 634, mixer 636, and ADC 638. The first amplifier 626 may be a pre-amplifier, power amplifier, or LNA. The second amplifier 628 may be a LNA. The third amplifier 630 may be a video amplifier.

In an example of operation, the heterodyne T/R module 600 operates similar to that described in FIG. 5 except that the first variable phase-shifter 622 and first variable attenuator 618 are dedicated to the transmit path, while the second variable phase-shifter 624 and second variable attenuator 620 are dedicated to the receive path as discussed analogously with regard to FIG. 4.

Referring back to FIGS. 3 and 4, an example of a control algorithm for the second variable phase-shifter 320 (or third variable phase-shifter 422) will now be discussed. In the case of FIG. 3, the control signal from controller 306 to the second variable phase-shifter 320 (via signal path 314) may be designated as a control variable ("CV"). The controller 306 monitors for the presence of any DC offset in the digitized signal 379 from the ADC 344. If the frequency reference signal 375 is not eliminated due to an error in the CV, the frequency reference signal 375 will be present as a DC offset in the resulting noise spectrum. This DC offset will change sign as the second variable phase-shifter 320 scans through quadrature (for example, from 80 to 100 degrees) such that it has one polarity on one side of the quadrature and an opposite polarity on the other side of quadrature. The effect of a control variable on a measurable variable ("MV") such as the DC offset may be used in a variety of control algorithms. For example, the change of sign in the DC offset may be used in a zero-crossing search. In general, a CV that produces a zero-crossing MV may have its range divided into a number of intervals. The controller 306 steps the CV through these intervals and observes the effect on the zero-crossing MV. For example, the zero-crossing MV may change sign with regard to two values $MV_0$ and $MV_1$ corresponding to values for the CV of $CV_0$ and $CV_1$, respectively. Given this straddling of the zero-crossing point, it may be shown that an optimal setting for the CV ("$CV_{opt}$") is:

$$CV_{opt} = \frac{CV_0 \times MV_1 - CV_1 \times MV_0}{MV_1 - MV_0} \qquad \text{Equation (1)}$$

In general, a $CV_{opt}$ will change with time due to temperature changes and other effects. This change with respect to time may be tracked using a convergence algorithm. For example, the straddling interval (corresponding to $CV_1$ and $CV_0$) may be reduced by a convergence factor such as two. A new value for $CV_{opt}$ is then calculated using, for example, Equation (1). The difference between successive measurements may then be averaged with previously-obtained differences to provide a time-varying-corrective factor. A calculated $CV_{opt}$ may then be adjusted according to the time-varying-corrective factor. Prior to updating the CV, a measurement of the MV with regard to a tolerance factor may be performed.

Figure 7:
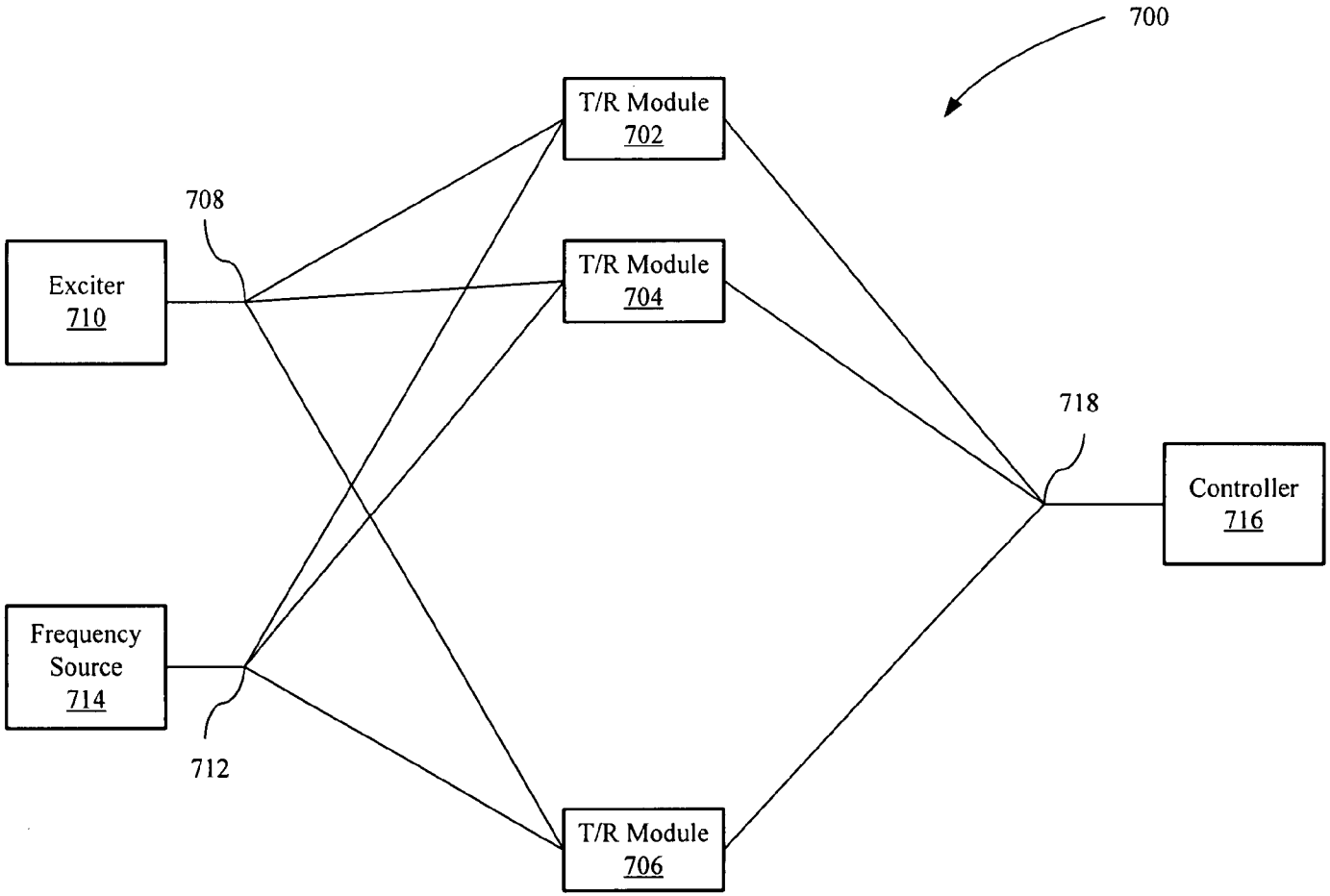
FIG. 7 shows a phase-array including a plurality of T/R modules in accordance with the invention.

Turning now to FIG. 7, a phase-array 700 is shown including a plurality of T/R modules 702, 704, and 706. The T/R modules 702, 704, and 706 may be implemented in the different ways discussed with regard to FIGS. 3, 4, 5, and 6. A first transmission network 708 couples the RF signal from exciter 710 to the T/R modules 702, 704, and 706. A similar second transmission network 712 couples the frequency reference signal from frequency source 714 to the T/R modules 702, 764, and 706. The resulting digital signals from the T/R modules may then be coupled to the controller 716 over a digital bus 718.

It will be understood, and is appreciated by persons skilled in the art, that one or more functions, modules, units, blocks, processes, sub-processes, or process steps described above may be performed by hardware and/or software. If the process is performed by software, the software may reside in software memory (not shown) in any of the devices described above. The software in software memory may include an ordered listing of executable instructions for implementing logical functions (i.e., "logic" that may be implemented either in digital form such as digital circuitry or source code or in analog form such as analog circuitry or an analog source such an analog electrical, sound or video signal), and may selectively be embodied in any computer-readable (or signal-bearing) medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "computer-readable medium" and/or "signal-bearing medium" is any means that may contain, store, communicate, propagate, or transport the program for use by or in connection with the instruction execution system, apparatus, or device. The computer readable medium may selectively be, for example but not limited to, an electronic, magnetic, optical, electromagnetic, infrared, or semiconductor system, apparatus, device, or propagation medium. More specific examples, but nonetheless a non-exhaustive list, of computer-readable media would include the following: an electrical connection (electronic) having one or more wires, a portable computer diskette (magnetic), a RAM (electronic), a read-only memory "ROM" (electronic), an erasable programmable read-only memory (EPROM or Flash memory) (electronic), an optical fiber (optical), and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A distributed receiver in signal communication with an active antenna array, the distributed receiver comprising:

an exciter operable to provide an RF signal;

a plurality of transmit/receive ("T/R") modules configured to receive the RF signal from the exciter through a first transmission network, each of the T/R modules configured to phase-shift the RF signal responsive to a control signal and transmit a resulting phase-shifted RF signal through a corresponding antenna, each of the T/R modules also being configured to phase-shift a received RF signal from the corresponding antenna to provide a phase-shifted received RF signal; and a frequency source operable to provide a frequency reference signal to each of the T/R module through a second transmission network, wherein each T/R module is configured to direct down-convert its phase-shifted received RF signal responsive to the frequency reference signal to provide a down-converted phase-shifted received RF signal.

2. The distributed receiver of claim 1, further comprising a plurality of analog-to-digital converters corresponding to each of the T/R modules, each analog-to-digital converter operable to digitize the down-converted phase-shifted received RF signal from the corresponding T/R module to provide a digital down-converted phase-shifted received RF signal.

3. The distributed receiver of claim 1, further including a transmission network in signal communication with the plurality of T/R modules and the active antenna array.

* * * * *